US007726351B2

(12) United States Patent
Puissant et al.

(10) Patent No.: US 7,726,351 B2
(45) Date of Patent: Jun. 1, 2010

(54) DEVICE FOR THE PICKING OF WEFT THREADS IN AN AIR JET WEAVING MACHINE

(75) Inventors: Patrick Puissant, Merelbeke (BE); Jean-Marie Bamelis, Ypres (BE)

(73) Assignee: Picanol N.V., Ypres (BE)

( * ) Notice: Subject to any disclaimer, the term of this patent is extended or adjusted under 35 U.S.C. 154(b) by 113 days.

(21) Appl. No.: 11/795,754

(22) PCT Filed: Jan. 17, 2006

(86) PCT No.: PCT/EP2006/000346

§ 371 (c)(1),
(2), (4) Date: Feb. 15, 2008

(87) PCT Pub. No.: WO2006/077063

PCT Pub. Date: Jul. 27, 2006

(65) Prior Publication Data

US 2008/0216912 A1 Sep. 11, 2008

(30) Foreign Application Priority Data

Jan. 21, 2005 (DE) ..... 10 2005 004 064

(51) Int. Cl.
*D03D 47/30* (2006.01)
*G06F 19/00* (2006.01)

(52) U.S. Cl. ..... 139/435.1; 139/435.2; 139/435.3; 139/435.4; 139/435.5; 139/435.6; 700/140

(58) Field of Classification Search ... 139/435.1–435.6; 700/140, 143
See application file for complete search history.

(56) References Cited

U.S. PATENT DOCUMENTS

| | | | | |
|---|---|---|---|---|
| 3,303,857 | A * | 2/1967 | Scheffel | 139/435.1 |
| 3,693,668 | A * | 9/1972 | Svaty | 139/435.3 |
| 3,734,143 | A * | 5/1973 | Svaty | 139/435.3 |
| 3,821,972 | A * | 7/1974 | Svaty et al. | 139/435.2 |
| 4,020,877 | A * | 5/1977 | Spisiak et al. | 139/435.2 |
| 4,183,382 | A * | 1/1980 | Scheffel | 139/435.2 |
| 4,328,842 | A * | 5/1982 | Scheffel | 139/435.5 |
| 4,347,872 | A * | 9/1982 | Brouwer et al. | 139/435.1 |

(Continued)

FOREIGN PATENT DOCUMENTS

DE 195 17 748 A1 11/1995

(Continued)

OTHER PUBLICATIONS

Search Report of German Patent Office regarding German Patent Application No. 10 2005 004 064.0, May 2005.

*Primary Examiner*—Bobby H Muromoto, Jr.
(74) *Attorney, Agent, or Firm*—Bacon & Thomas, PLLC

(57) ABSTRACT

A device for inserting of weft threads in an air jet weaving machine comprising at least one set of main nozzles (13, 14) which are mounted in series, and to which individual regulating valves (21, 22) are assigned, is provided with a control and regulating unit (17) which defines the individual settings of the regulating valves (21, 22) with respect to one another, in order to form an overall value for the intensity of the impulse transmission of the set of main nozzles with each regulating valve contributing a proportion of the overall impulse intensity.

4 Claims, 4 Drawing Sheets

U.S. PATENT DOCUMENTS

Figure 1:
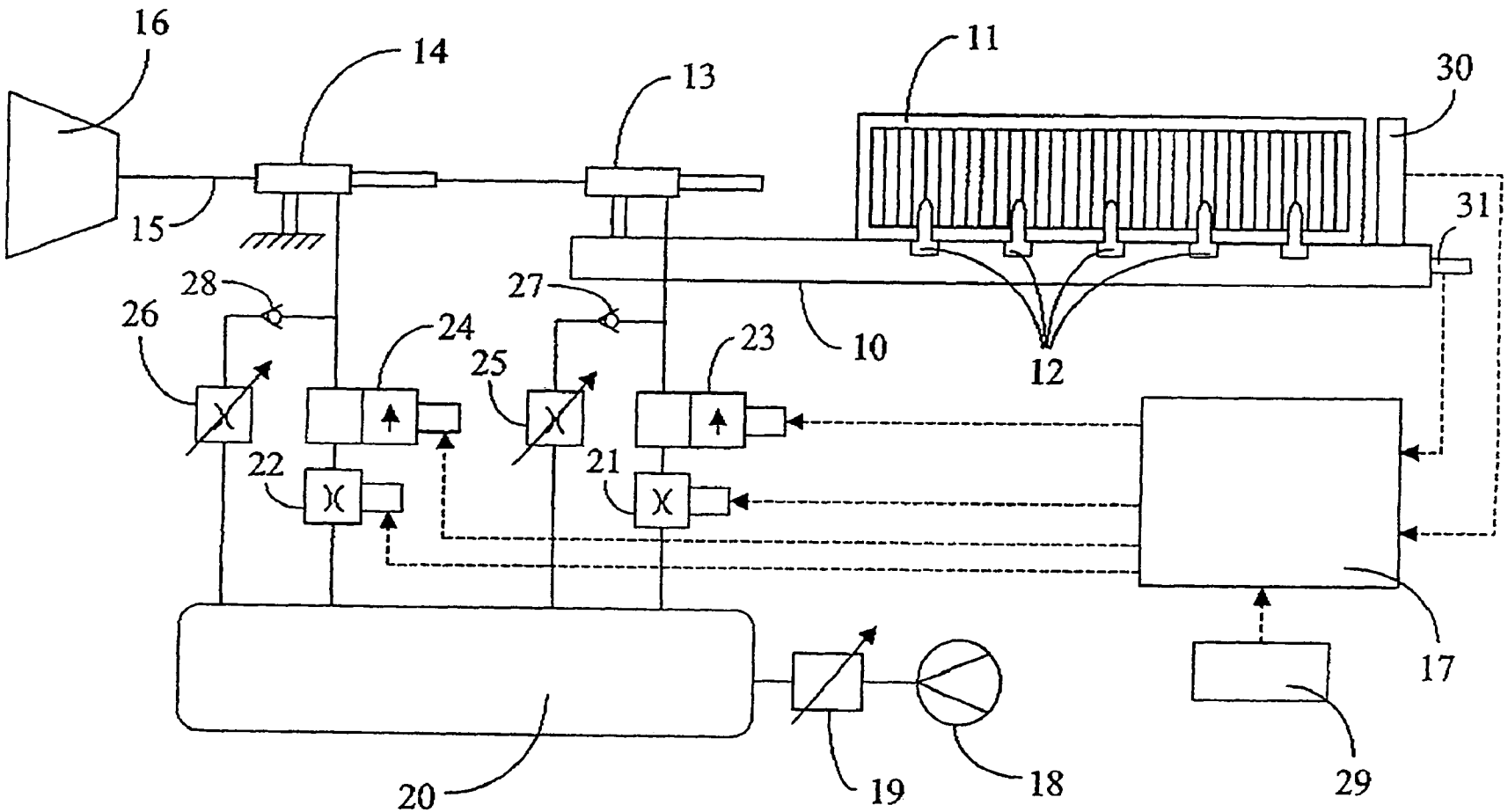

| | | | | | |
|---|---|---|---|---|---|
| 4,410,016 | A | * | 10/1983 | Manders | 139/435.2 |
| 4,450,876 | A | * | 5/1984 | van Mullekom | 139/435.2 |
| 4,458,729 | A | * | 7/1984 | Brouwer et al. | 139/435.1 |
| 4,466,468 | A | * | 8/1984 | Brouwer et al. | 139/435.4 |
| 4,501,008 | A | * | 2/1985 | Rosseel et al. | 377/2 |
| 4,534,387 | A | * | 8/1985 | van Hest | 139/435.2 |
| 4,651,785 | A | * | 3/1987 | Volland et al. | 139/435.2 |
| 4,703,779 | A | * | 11/1987 | Philippe et al. | 139/435.5 |
| 4,722,370 | A | * | 2/1988 | Manders | 139/429 |
| 4,759,392 | A | * | 7/1988 | van Bogaert et al. | 139/435.2 |
| 4,850,398 | A | * | 7/1989 | Van Bogaert | 139/435.1 |
| 5,031,672 | A | * | 7/1991 | Wahhoud et al. | 139/435.2 |
| 5,086,812 | A | * | 2/1992 | Van Bogaert et al. | 139/435.2 |
| 5,111,852 | A | * | 5/1992 | Verhulst | 139/435.4 |
| 5,197,520 | A | * | 3/1993 | Reimertz | 139/1 C |
| 5,303,746 | A | * | 4/1994 | Wahhoud et al. | 139/435.2 |
| 5,388,618 | A | * | 2/1995 | Decock | 139/1 R |
| 5,417,250 | A | * | 5/1995 | Markey | 139/435.3 |
| 5,462,095 | A | * | 10/1995 | Okesaku | 139/435.4 |
| 5,816,296 | A | * | 10/1998 | Schuster | 139/450 |
| 5,970,996 | A | * | 10/1999 | Markey et al. | 137/1 |
| 6,062,273 | A | * | 5/2000 | Peeters et al. | 139/435.2 |
| 6,109,309 | A | * | 8/2000 | Dornier et al. | 139/435.3 |
| 6,223,783 | B1 | * | 5/2001 | Peeters et al. | 139/435.4 |
| 6,305,433 | B1 | * | 10/2001 | Peeters | 139/435.3 |
| 6,748,981 | B2 | * | 6/2004 | Gielen et al. | 139/435.2 |
| 7,110,847 | B2 | * | 9/2006 | Ostyn | 700/140 |
| 7,350,542 | B2 | * | 4/2008 | Peeters et al. | 139/116.1 |
| 2002/0170615 | A1 | * | 11/2002 | Gielen et al. | 139/435.2 |

FOREIGN PATENT DOCUMENTS

| | | | | |
|---|---|---|---|---|
| DE | 692 13 975 | T2 | | 4/1997 |
| EP | 0 239 137 | A1 | | 9/1987 |
| EP | 0 442 546 | A1 | | 8/1991 |
| EP | 442546 | A1 | * | 8/1991 |
| EP | 0 879 307 | B1 | | 11/1998 |
| EP | 1 086 265 | B1 | | 3/2001 |
| EP | 1 420 095 | A2 | | 5/2004 |
| EP | 1 473 391 | A1 | | 11/2004 |

* cited by examiner

DEVICE FOR THE PICKING OF WEFT THREADS IN AN AIR JET WEAVING MACHINE

The invention relates to a device for inserting of weft threads in an air jet weaving machine comprising at least one set of main nozzles which are mounted in series, to each of which a regulating valve is individually assigned, the settings of which determine the intensity of impulse transmission to the weft thread, the regulating valves being independently settable by means of a control and regulating unit.

A set of main nozzles mounted in series serves for inserting a weft thread each pick or weft insertion. In most instances, two main nozzles are mounted in series, of which one is arranged stationarily and the other is arranged on a batten.

It is known (EP 0 239 137 B1) for only the stationarily arranged main nozzle to be preceded by a regulating valve and for the following main nozzle to be supplied with an unregulated compressed air stream. In this known device, the impact of the stationary main nozzle may be relatively low, whereas the impact of the following main nozzle is always very high. The result of this may be that the following main nozzle blows too strongly, that is to say has too great a share of the total impulse transmitted to the weft thread, which may be unfavorable for the weft threads and weft insertions.

It is also known (EP 0 879 307 B1) to assign to each set of main nozzles mounted in series a common regulating valve and a common switching valve. In a device of this type, it is relatively difficult to coordinate the impacts of the main nozzles mounted in series with one another correctly, that is to say to set a suitable impulse transmission.

It is also known (EP 1 086 265 B1) to assign specific regulating valves to the main nozzles of a set which are arranged in series, so that impulse transmission can be set individually for each main nozzle. Individual setting may, in practice, lead to problems, since the proportional contributions of each of the main nozzles mounted to series in the overall impulse transmission should be coordinated with one another. On the one hand, what should be ensured is that a weft thread is sufficiently tensioned between the main nozzles, so that it cannot sag in loops or the like. On the other hand, however, a weft thread should not be exposed to excessively high forces so that it is not damaged.

The object on which the invention is based is to provide a device of the type initially mentioned, in which the coordination of the proportions of the main nozzles in impulse transmission does not present any problems.

This object is achieved in that the control and regulating unit defines the settings of the individual regulating valves of a set of main nozzles with respect to one another, in order to form an overall value for the intensity of the impulse transmission of the set of main nozzles.

By virtue of the design according to the invention, when a weaving machine is set to a new fabric, only one overall value for the intensity of impulse transmission has to be set. The control and regulating unit then automatically assumes the setting of the individual regulating valves in a predetermined ratio to one another. This automatic assignment of the settings of the regulating valves to one another is maintained even when the weft insertion is regulated, for example for inserting of weft threads consisting of filament yarn. In this case, it is expedient, for example, to carry out regulation to a constant arrival angle, that is to say to an angle of the main shaft of the weaving machine at which a weft thread arrives on the opposite side. in this regulation, the impulse transmission becomes the manipulated variable which changes as a function of the diameter of a weft thread bobbin. Where weft threads consisting of filament yarn are concerned, the situation often arises where weft threads have to be inserted from the outer layers of the bobbin by means of a greater quantity of compressed air and/or compressed air at higher pressure than toward the end of the used-up bobbin. In order to maintain a constant arrival angle, the quantity of compressed air and/or the pressure of the compressed air as manipulated variable is varied by the control and regulating unit. During this variation of the manipulated variable, the control and regulating unit automatically ensures that the ratio of the settings of the individual regulating valves of the main nozzles of a set is suitably maintained according to predetermined criteria.

Figure 2:
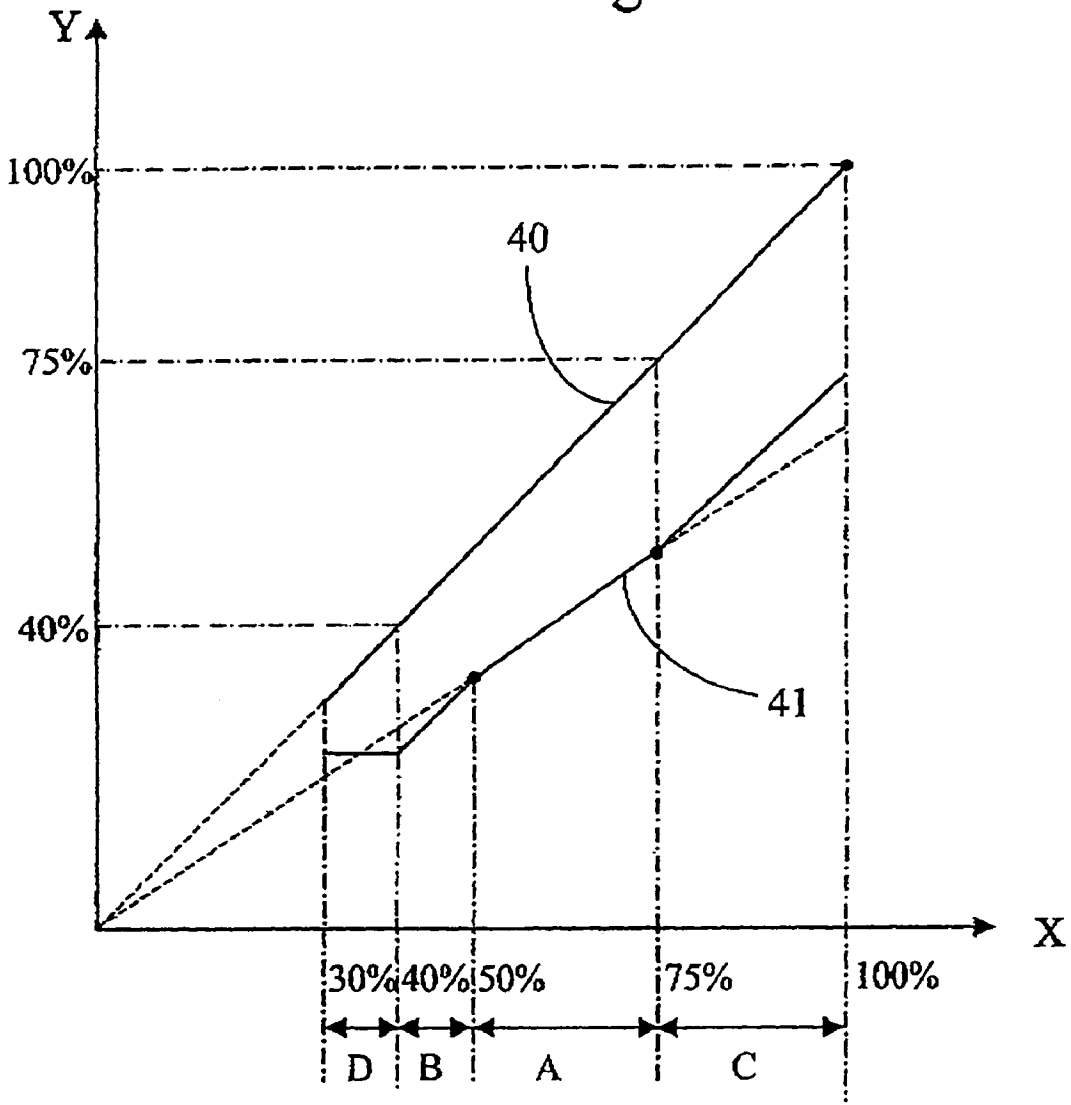
Figure 3:
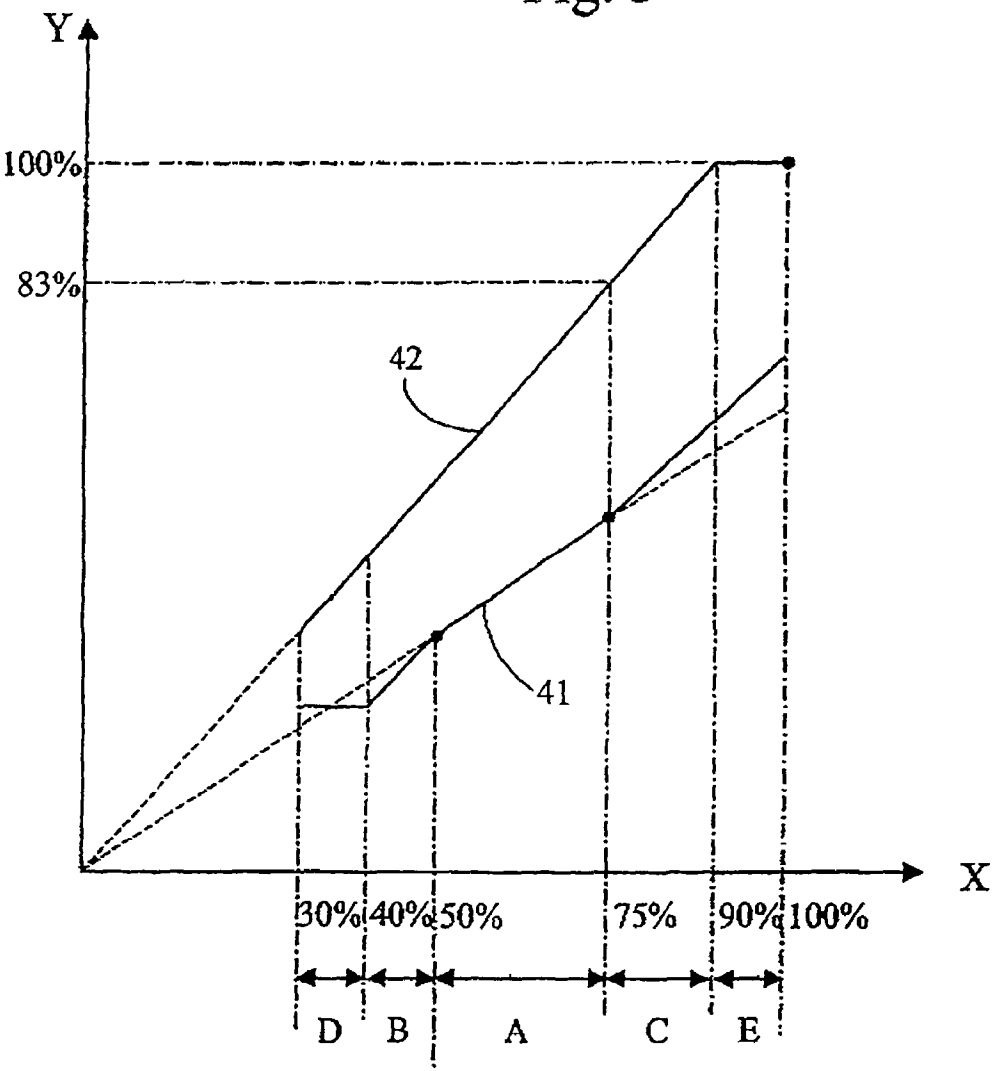
Figure 4:
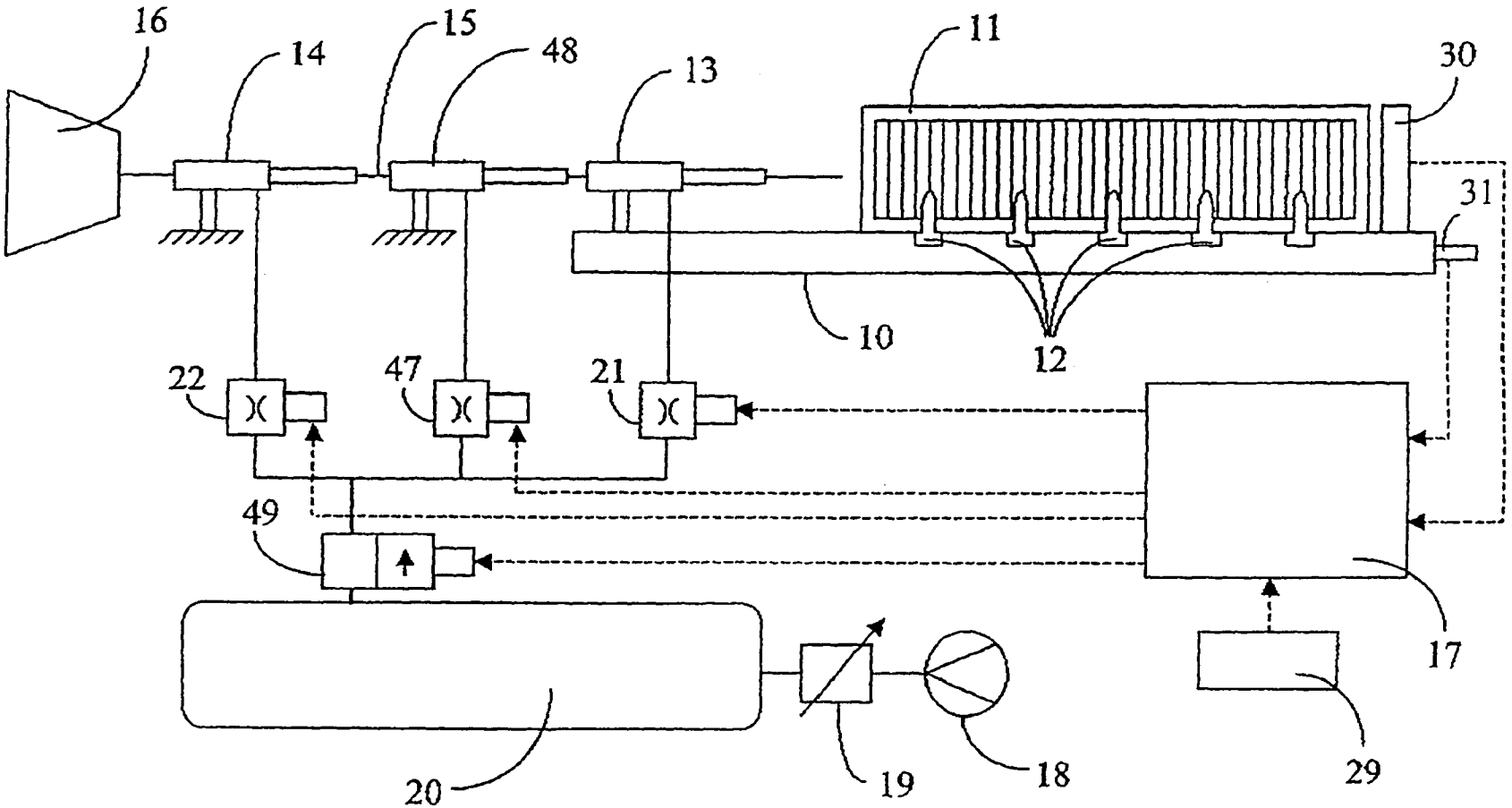

Further features and advantages of the invention may be gathered from the following description of the embodiments illustrated in the drawings in which:

FIG. 1 shows a diagrammatic illustration of a device according to the invention for inserting of weft threads in an air jet weaving machine, FIG. 2 shows a graph in which the settings of the individual regulating valves of two main nozzles mounted in series are illustrated as a percentage of the opening cross section of the regulating valves vs. the overall value of the settable impulse transmission as a percentage, FIG. 3 shows a graph, similar to FIG. 2, with a modified profile of the settings of the regulating valves vs. the impulse transmission, and FIG. 4 shows a diagrammatic illustration of a device according to the invention with a set of three main nozzles mounted in series for inserting of a weft thread.

In FIG. 1, of a weaving machine, a batten 10 on which a reed 11 and relay nozzles 12 are arranged is indicated. The batten 10 driven in to-and-fro pivoting movements has arranged on it, on the picking side, a main nozzle 13 which with a preceding main nozzle 14 forms a set of main nozzles serving for the insertion of a weft thread 15. The main nozzle 14 is mounted stationarily on the frame of the weaving machine.

A weft thread 15 is metered in a known way by means of a prewinding apparatus 16 and is blown by the main nozzles 13, 14 into a shed formed from warp threads. Within the shed, the weft thread is taken over by the relay nozzles 12, that is to say by the air streams blown from these, and is transported further on to the opposite side of the weaving machine. The arrival of the weft thread 15 on the side lying opposite the insertion side is detected by means of a weft thread monitor 30 and is communicated as a pulse signal to a control and regulating unit 17. The relay nozzles 12 are connected to a compressed air supply arrangement which is not illustrated in any more detail.

The main nozzles 13, 14 are likewise connected to a compressed air source or an arrangement for the supply of compressed air. This contains, in the exemplary embodiment, a compressed air source 18 which feeds compressed air to a tank 20 via a pressure regulating valve 19. The main nozzles 13, 14 are connected to the tank 20 in each case via a regulating valve 21, 22 and a switching valve 23, 24. The control and regulating unit 17 determines the switching time points of the switching valves 23, 24 and the settings of the regulating valves 21, 22. In addition, the main nozzles 13, 14 are connected to the tank via reducing valves 25, 26. A nonreturn valve 27, 28 is provided in each case in the line between the reducing valves 25, 26 and the main nozzles 13, 14.

The regulating valves 21, 22 are preferably quantity regulating valves, by means of which the compressed air quantity flowing to the main nozzles 13, 14 when the switching valves 23, 24 are opened can be regulated. In the weft intermissions, that is to say when the switching valves 23, 24 are closed, compressed air flows out of the tank 20 via the reducing valves 25, 26 to the main nozzles 13, 14. Consequently, in the main nozzles 13, 14, a compressed air flow is maintained which keeps the weft thread 15 tensioned. In a modified embodiment, the regulating valves 21, 22 are pressure regulating valves.

The control and regulating unit 17 further receives information on the instantaneous angular position of the main shaft of the weaving machine. In the exemplary embodiment, this takes place, for example, via an angle detector 31 which is assigned to the shaft of the batten 10.

Further, to the control and regulating unit 17 is assigned an input unit 29, by means of which, for example, the desired value for the arrival angle of the main shaft can be entered, that is to say the angular position which is detected by the angle detector 31 and at which the weft thread 15 is to reach the weft thread monitor 30. Furthermore, by means of the input unit 29, the operator can also set the impulse transmission, exerted by the set of main nozzles 13, 14, to the weft thread 15. As illustrated in FIG. 2 by the X-axis, a setting range of about 25% to 100% is provided for the impulse transmission. When the operator preselects an impulse transmission within this range, the control and regulating unit 17 automatically assigns settings of the regulating valves 21, 22 of the main nozzles 13, 14, so that they assume a selected proportion of the total impulse transmission that has been preset by the operator, that is to say, for example, by varying the opening cross sections of these regulating valves 21, 22. The settings of the regulating valves 21, 22 determine what proportion the respective main nozzle 13, 14 has in the overall preset impulse transmission to the weft thread 15.

In the exemplary embodiment according to FIG. 2, there is provision, for example, for the regulating valve 21 of the main nozzle 13 to be set proportionally to the selected overall impulse transmission according to the straight line 40, so that, in the case of an impulse transmission of 100%, the regulating valve 21 is completely open, that is to say the opening cross section amounts to 100%. Correspondingly, in the case of an impulse transmission of 25%, the opening cross section amounts to 25%, etc. The control and regulating unit 17 automatically also assigns a setting of the regulating valve 22 of the main nozzle 14 to the value of the selected overall impulse transmission. This assignment is illustrated by the curve 41 in FIG. 2. In the exemplary embodiment, there is provision for the regulating valve 22 to open to a lesser extent than the regulating valve 21 in the range A between, for example, 50% and 75% of the selectable impulse transmission, that is to say the curve 41 possesses a lower gradient than the curve 40. In the preceding range B of, for example, 40% to 50%, the adjustment of the two valves 21, 22 takes place in such a way that a constant difference is maintained, that is to say the curves 40, 41 have the same gradient. This setting is also provided in the range C between 75% and 100%, in which there is likewise a constant difference between the opening cross sections of the valves 21, 22 and consequently between the curves 40, 41. In the range D below 40%, there is provision, in the exemplary embodiment, for the opening cross section of the regulating valve 22 to be maintained at a constant minimum value. In all the segments A, B, C and D, there is provision for the setting of the valve 22 to be such that the proportion of the main nozzle 14 in impulse transmission is lower than the proportion of the main nozzle 13 in impulse transmission. This may also be achieved, for example, in that the regulating valve 22 has a smaller opening cross section or, if it is configured identically to the regulating valve 21, is opened only to lower opening cross sections.

There may be provision for inputting in the control and regulating unit 17 a plurality of profiles for the curves 40, 41 which an operator can select according to previously known criteria in order to optimize the weft insertion. Alternatively, however, there may also be provision for the operator to configure the profile of the curves 40 or 41 and, in particular, the profile of the curve 41 himself and thus to determine the ratio at which the control and regulating unit then implements the ratio of the settings of the regulating valves 21, 22 of the main nozzles 13, 14 with respect to one another.

In the exemplary embodiment according to FIG. 3, there is provision for the adjustment of the regulating valve 21 of the main nozzle 13 to set the value of impulse transmission to take place along curve 42 such that, for example, even in the case of an impulse transmission of 75%, a setting of 83% of the opening cross section of the regulating valve 21 of the main nozzle 13 is achieved and, in the case of an impulse transmission of 90%, even an opening cross section of 100%. In the range between 90% and 100% of impulse transmission, an increase therefore takes place essentially only due to an increase in impulse transmission by means of the main nozzle 14, the regulating valve 22 of which is also varied within this range along curve 41, for example is set to a higher opening cross section.

It becomes clear from the foregoing that the setting of the overall impulse transmission takes place by means of an "imaginary" or virtual main nozzle. The weaver sets a value for overall impulse transmission of, for example, 80%, the control and regulating unit 17 then automatically setting the regulating valves 21, 22 to suitable values, for example such that the opening cross section of the regulating valve 21 is set at 90% and the opening cross section of the regulating valve 22 of the main nozzle 14 is set at 70%.

The regulating valves 21, 22 are expediently equipped with stepping motors which allow an exact setting of the opening cross sections of the regulating valves 21, 22. The control and regulating unit 17 activates these stepping motors by means of pulses. Regulating valves of this type are known, for example, from EP 879 307 B1 and EP 1 086 265 B1.

If the weft threads are woven from filament yarn, it is possible to regulate the weft insertion. It has been shown that welt threads 15 consisting of filament yarn are relatively air-unfriendly when they come from outer layers of a weft thread bobbin. They are more and more air-friendly when they come from layers of this weft thread bobbin which lie further inward. At the commencement of the working off of a weft thread bobbin, therefore, a higher impulse transmission is required, that is to say a relatively high pressure and/or a relatively high quantity per unit time of compressed air, which are then reduced more and more, the further this weft thread bobbin is worked off. This reduction in impulse transmission may take place by means of a regulating arrangement which by means of the weft thread monitor 30 detects the arrival of the weft thread on the side lying opposite the main nozzles 13, 14 and communicates this arrival to the control and regulating unit 17. The control and regulating unit 17 additionally receives information on the instantaneous rotary angle of the main shaft of the weaving machine, for example by means of the angle detector 31 of the shaft of the batten 10. By means of these signals, it is detected whether a weft thread has arrived in the correct angular position of the main shaft of the weaving machine. In the event of deviations, regulation takes place via the setting of the overall impulse transmission, that is to say the setting of the regulating valves 21, 22, in such a way that a constant arrival angle is obtained. The control and regulating unit 17 in this case automatically sets the ratio of the settings of the regulating valves 21, 22 according to the changed overall impulse transmission.

In the embodiment according to FIG. 4, there is provision for the set of main nozzles serving for the insertion of a weft thread 15 to consist of the main nozzle 13 arranged on the batten 10, a stationary main nozzle 14 and of an interposed, likewise stationary main nozzle 48, that is to say of three main nozzles 13, 48, 14 mounted in series. These main nozzles are in each case assigned individual regulating valves 21, 22, 47 which are individually actuated by the control and regulating unit 17. The regulating valves 21, 22, 47 are preceded by a common switching valve 49 which connects these regulating valves 21, 22, 47 to the tank 20. The common switching valve 49 is actuated by the control and regulating unit 17. In this embodiment, too, the control and regulating unit 17 defines the ratio at which the regulating valves 21, 22, 47 are set with respect to one another, that is to say the proportion of the overall impulse transmitted by each of the main nozzles 13, 48, 14.

In this embodiment according to FIG. 4, too, the weaver selects an impulse transmission of an "imaginary" or virtual main nozzle which the control and regulating unit then automatically apportions to the main nozzles, 13, 48, 14 individually by means of the setting of the regulating valves 21, 47, 22, without the weaver noticing anything of this when the weaving machine is in normal operation.

The main nozzles may, in principle, be of any desired number. In so far as more than two main nozzles are provided, according to the invention at least two main nozzles should in each case be assigned a regulating valve settable by the control and regulating unit 17.

The operator of the weaving machine, usually a weaver, determines how the control and regulating unit is to operate. In this case, the weaver can also decide that, during weaving, the control and regulating unit, which, for example, has carried out a setting of the regulating valves 21, 22 according to FIG. 2, changes to a setting according to FIG. 3. For example, a decision can be made that, while the weaving machine is operating with regulation to a constant arrival angle, a change to a setting according to FIG. 3 is made from the setting of the regulating valves according to FIG. 2 in the case of an overall impulse transmission of 75%. The regulating valve 21 is then no longer set at the value of 75%, but at the value of 83% according to the curve 42 according to FIG. 3.

In the exemplary embodiments according to FIGS. 2 and 3, the curves 41 are in each case identical. This is only one example, however, since the curves may also be formed substantially differently. In particular, it is also possible to provide, over the entire setting range of the impulse transmission, for the ratio of the settings between the regulating valves 21, 22 of the main nozzles 13, 14 to remain constant or for a constant difference to be maintained over the entire setting range.

The invention claimed is:

1. A device for inserting weft threads in an air jet weaving machine comprising: at least one set of main nozzles arranged in series to collectively transmit a preset overall air jet impulse to each weft thread inserted during weaving; an individual regulating valve connected to each main nozzle and which is controllable by settings received from a control and regulating unit to set values of the intensities of air jet impulses transmitted by the respective main nozzle connected to said regulating valve to the weft threads during weft insertion; said control and regulating unit arranged to enable selective control of a value of the preset overall air jet impulse and to control, in response to a setting of a preset overall air jet impulse value, the settings of the individual regulating valves with respect to one another so each respective main nozzle connected to the regulating valves exerts on an inserted weft thread a selected proportion of said preset overall air jet impulse transmitted by the set of main nozzles.

2. The device as claimed in claim 1, wherein the control and regulating unit, at least in a first part range (B, C) of the preset overall air jet impulse transmitted by the main nozzles during weft insertion, is arranged to adjust the settings of the individual regulating valves so as to define a constant ratio between the settings of the regulating valves with respect to one another so they each cause a respective main nozzle to transmit a constant proportion of the total of said preset overall air jet impulse during weft insertion.

3. The device as claimed in claim 1, wherein the control and regulating unit, at least in a second part range (D, E) of the preset overall air jet impulse transmitted by the main nozzles during weft insertion, is arranged to adjust the setting of at least one of the individual regulating valves so as to maintain constant a proportional air jet impulse transmitted by at least the respective main nozzle to which the at least one regulating valve is connected.

4. The device as claimed in claim 1, wherein the control and regulating unit, at least in a third part range (A) of the preset overall air jet impulse transmitted by the main nozzles during weft insertion, is arranged to adjust the settings of the individual regulating valves so as to define ratios between the settings of the regulating valves with respect to one another so as to cause each respective main nozzle to transmit a proportion of the total of said preset overall air jet impulse during weft insertion according to a predetermined profile.

* * * * *